United States Patent [19]

Noguchi

[11] Patent Number: 4,891,294

[45] Date of Patent: Jan. 2, 1990

[54] ELECTROSTATIC DEVELOPMENT TONER

[75] Inventor: Koji Noguchi, Saitama, Japan

[73] Assignee: Hitachi Metals, Ltd., Tokyo, Japan

[21] Appl. No.: 216,048

[22] Filed: Jul. 7, 1988

[30] Foreign Application Priority Data

Jul. 9, 1987 [JP] Japan ..... 62-171897
Jul. 9, 1987 [JP] Japan ..... 62-171937

[51] Int. Cl.[4] ..... G03G 9/08

[52] U.S. Cl. ..... 430/110; 430/903; 430/111

[58] Field of Search ..... 430/110, 903

[56] References Cited

U.S. PATENT DOCUMENTS

| | | | |
|---|---|---|---|
| 4,111,823 | 9/1978 | Kobayashi et al. | 430/110 |
| 4,121,931 | 10/1978 | Nelson | 430/122 |
| 4,395,485 | 7/1983 | Kashiwagi et al. | 430/110 X |
| 4,758,493 | 7/1988 | Young et al. | 430/903 X |
| 4,824,754 | 4/1989 | Mikami | 430/110 |

FOREIGN PATENT DOCUMENTS

| | | | |
|---|---|---|---|
| 54-19747 | 2/1979 | Japan | 430/110 |
| 55-166652 | 12/1980 | Japan | 430/110 |
| 56-128956 | 10/1981 | Japan | 430/110 |
| 59-191069 | 10/1984 | Japan | 430/110 |
| 60-123858 | 7/1985 | Japan | 430/110 |
| 60-243665 | 12/1985 | Japan | 430/110 |

OTHER PUBLICATIONS

"Plastic Additives", [ed. Y. Abe, pub. Taisei-sha, 1987].

*Primary Examiner*—Roland E. Martin
*Attorney, Agent, or Firm*—Finnegan, Henderson, Farabow, Garrett & Dunner

[57] ABSTRACT

Electrostatic development toner for use in nonmagnetic one-component development comprising a binder resin, calcium carbonate and ceramic fine powder having an average particle size of 3 μm or less.

4 Claims, 1 Drawing Sheet

ELECTROSTATIC DEVELOPMENT TONER

BACKGROUND OF THE INVENTION

The present invention relates to electrostatic development toner, and more particularly to one-component nonmagnetic toner for use in electrophotography, electrostatic printing, etc.

In electrophotography, electrostatic printing, etc., an electrostatic latent image is formed on the surface of a photosensitive member by various methods, and is developed by toner to provide a toner image which is then transferred onto a plain paper, etc. and fixed thereto.

The development of an electrostatic latent image is usually carried out by a magnetic brush method, and in this magnetic brush method, a two-component developer composed of a carrier such as iron powder and ferrite powder and toner consisting mainly of a resin and a colorant is widely used. In the case of a two-component developer, however, a mixing ratio of the toner to the carrier (toner concentration) should be strictly controlled to obtain a stable image, necessitating a control means for toner concentration. Further, the carrier surface is contaminated by the toner after a long period of use, resulting in the decrease in the triboelectric charging ability of the carrier.

To eliminate these problems, a one-component development method using magnetic toner consisting essentially of a resin and magnetic powder has been developed and widely used. In the one-component development method, insulating magnetic toner is usually used to achieve good image transfer (see, for instance, U.S. Pat. No. 4,121,931). With respect to development with magnetic toner, various methods have been proposed. Among them, a method of triboelectrically charging the toner by friction between toner particles themselves or between toner particles and a sleeve, etc. is widely used.

The development method utilizing the triboelectric charging of the toner, however, suffers from the disadvantage that the toner tends to agglomerate, and that the image quality varies with environmental conditions. Further, since the magnetic toner contains 20–70 wt % or so of magnetic powder such as magnetite, it is inferior to the two-component developer in fixability.

Because of these problems, much attention has been paid to a nonmagnetic one-component toner containing no magnetic powder. Known development methods using such nonmagnetic one-component developer are an impression development method, a touchdown development method and a jumping development method. However, the impression development method and the touchdown development method are likely to cause fogging because a toner-bearing member and a photosensitive member are in contact with each other. And in the jumping development method, it is necessary to narrow the gap between a toner-bearing member and a photosensitive member and to supply a thin layer of the toner to this gap to increase a development efficiency. However, it is usually difficult to form a uniform thin layer of the toner.

To eliminate these problems, investigations have used as a toner-bearing member a sleeve equipped with a plurality of floating electrodes on the surface. As shown in FIG. 2, a sleeve 1 is constituted by a cylindrical substrate 2 made of nonmagnetic and conductive materials such as aluminum, stainless steel, etc., a dielectric layer 3 formed on the cylindrical substrate 2, and fine electrodes 4 constituted by a large number of conductive particles dispersed in a mutually insulated state on the surface of the dielectric layer 3. The sleeve of such structure is disclosed, for instance, in Japanese Patent Laid-Open No. 60-225179. In an apparatus shown in FIG. 1, sleeve 1 is rotated and a bias voltage source 7 is connected between the sleeve 1 and a doctor blade 6. In this apparatus, toner 8 contained in a hopper 5 is fed onto the rotating sleeve 1 while the doctor blade 6 regulates a thickness and triboelectric charge of the toner 8, whereby an electrostatic latent image (not shown) formed on the surface of the photosensitive drum 10 is developed. According to this development method, sufficient edge effects can be stably obtained, providing good pictorial and linear images.

Despite the fact that good images can be obtained by a development method using nonmagnetic one-component developer and a sleeve provided with a large number of electrodes, it is disadvatageous for the following reasons.

Since the usual nonmagnetic one-component toner is composed mainly of a binder resin and a colorant, the toner tends to adhere to the sleeve surface after a long period of use, thereby forming a thin insulating layer on the surface of the sleeve. As a result, even if a bias voltage is applied to the sleeve, the electric field between the fine electrodes and the photoconductive drum is weakened, resulting in decrease in a image density.

OBJECT AND SUMMARY OF THE INVENTION

Therefore, an object of the present invention is to provide electrostatic development toner which can provide a good image even after producing a large number of copies according to a nonmagnetic one-component development method.

The electrostatic development according to the present invention comprises a binder resin, a colorant, calcium carbonate and ceramic fine particles having an average particle size of 3 μm or less.

DETAILED DESCRIPTION OF THE INVENTION

Figure 1:
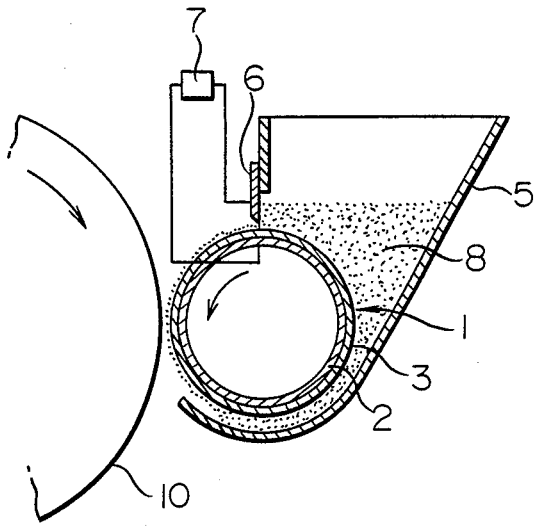
FIG. 1 is a schematic cross-sectional view showing a development apparatus using the toner of the present invention.

In the present invention, calcium carbonate and ceramic fine powder particles are added to the toner, and parts of these fine particles are exposed on the surface of the toner to provide the function of abrading the sleeve surface, thereby preventing the toner from being adhered to the sleeve surface.

Particularly, calcium carbonate is necessary to prevent the filming of toner particles on a sleeve, namely, to prevent the toner particles from adhering to a sleeve in the form of a thin layer. Ceramic fine powder also serves to prevent the toner particles from adhering to a sleeve by scratching the sleeve surface. It is surprising that sufficient effect of preventing the adhesion of toner particles to a sleeve cannot be obtained without using both calcium carbonate and ceramic fine powder.

Calcium carbonate fine particles are usually 1.0 μm or less in particle size, and their content is preferably 1–10 wt %. When the calcium carbonate particles are larger than 1.0 μm in average particle size, sufficient effect of preventing the adhesion of toner particles cannot be achieved. When their content is lower than 1 wt %, the above effect is insufficient, and when it exceeds 10 wt %, the fixability of the toner decreases.

Ceramic fine particles should have an average particle size of 3 μm or less. When the average particle size exceeds 3 μm, the surface of a sleeve or a photosensitive drum is damaged by the toner. On the other hand, when the ceramic fine particles are too small, sufficient effect of preventing the adhesion of toner particles to a sleeve cannot be obtained. Thus, the lower limit of the ceramic fine powder is preferably 0.1 μm. The preferred average particle size of ceramic fine particles is 0.1–2 μm. And when the amount of ceramic fine particles is too small, sufficient effect cannot be obtained. On the other hand, when it is too large the ceramic fine particles are likely to damage the surfaces of the toner development members such as a sleeve, a photosensitive drum, etc. Therefore, the amount of ceramic fine powder is preferably 0.3–3.5 wt %, and more preferably 0.5–2.0 wt %. Further, when the ceramic fine particles are applied to the toner particles, the amount of the ceramic fine particles is desirably 0.2–1.0 wt %.

Ceramics which can be used as ceramic fine powder in the present invention are those having high abrasion characteristic, high hardness and high strength, and they are preferably non-oxide ceramics such as nitride or carbide ceramics or a mixture thereof. Such ceramics include, for instance, $B_4C$, TiC, SiC, TiN, $Si_3N_4$, etc.

Such ceramic fine particles may be produced by any known method. For instance, they can be produced by heating ceramics or a mixture of ceramics and metals or carbon by an arc or plasma jet generated in hydrogen, nitrogen or their mixed gas (Japanese Patent Laid-Open No. 59-227765).

These ceramic fine particles may be treated to become hydrophobic. Agents for making ceramic fine particles hydrophobic include silane coupling agents having hydrophobic groups such as hexamethyldisilazane (HMDS), octyltrimethoxysilane, etc., silicone oils such as dimethylsilicone oil, methyl hydrogen silicone oil, etc. These hydrophobic agents are used in the form of a solution in an organic solvent such as benzene, toluene, hexane, etc. In the case of using hydrophobic ceramics, toner particles having such ceramic fine powder exposed on their surfaces or coated with such ceramic particles are not likely to absorb moisture even at high humidity, which means that the resistivity of the toner does not decrease and so can provide a high-quality transferred image.

The binder resins which may be contained in the toner of the present invention include styrene resins such as polystyrene, styrene-butadiene copolymer, styrene-acrylate copolymer and styrene-methacrylate copolymer, epoxy resins, polyester resins, etc., and they may be used alone or in combination.

The colorants which may be used include known pigments and dyes such as carbon black, chrome yellow, Hansa yellow, benzidine yellow, rose rouge, aniline red, phthalocyanine blue, aniline blue, nigrosine dye, aniline black, etc. The content of such colorant is desirably 3–15 wt %.

In addition to the above calcium carbonate, ceramic fine powder, binder resin and colorant, the toner of the present invention may contain a charge control agent, a releasing agent, a flow improver, a filler, etc. The charge control agents include nigrosine dye, a reaction product of nigrosine dye and a carboxylic group-containing resin, triphenylmethane dye, metal(Cr)-containing azo dye, etc. The releasing agents include polypropylene, polyethylene, paraffin wax, carnauba wax, amide wax, etc. The flow improvers include metal oxide fine powder such as hydrophobic silica and alumina. The fillers include inorganic fine powder such as talc, clay, etc. The amounts of these additives may be determined depending upon the properties required for the toner, but generally the charge control agent is 1–5 wt %, the releasing agent 1–5 wt %, the flow improver 0.1–3 wt %, and the filler 1–10 wt %. Further, as an agent for preventing filming to a photosensitive drum, resin fine powder such as methyl methacrylate fine powder is effective. In this case, the amount of resin fine powder is desirably 0.1–5 wt % based on the toner.

The toner of the present invention may be produced by a known method such as pulverization, spray-drying, etc. According to a pulverization method, each starting material is ball-milled or dry-milled to provide a premixture, blended by a kneader or rolls while heating, pulverized by a jet mill, etc. after solidification and then classified. The colorant, the charge control agent, the releasing agent, the fillers, etc. are uniformly dispersed in the binder resin, and the calcium carbonate and the ceramic fine particles are dispersed in the toner or applied onto the surface of the toner. When they are contained in the toner, they are partially exposed on the toner surface so that the toner does not tend to adhere to the sleeve surface. When further ceramic fine particles are applied to the toner surface to provide a coated toner, the above objective is surely achieved. From the viewpoint of image quality, the toner should have an average particle size of 5–20 μm.

The present invention will be described in further detail by the following Examples.

EXAMPLE 1

77 parts by weight of styrene-acrylic copolymer (Highmer SBM 600 manufactured by Sanyo Chemical Co., Ltd.), 10 parts by weight of carbon black (#50 manufactured by Mitsubishi Kasei Kogyo K.K.), 3 parts by weight of low-molecular weight polypropylene (Bischol 550P manufactured by Sanyo Chemical Co., Ltd.), 2 parts by weight of an charge control agent (Bontron S54 manufactured by Orient Chemical Industries Ltd.), 1 part by weight of silicon carbide fine powder (DU A-1 manufactured by Showa Denko K.K., average particle size: 0.45 μm), and 7 parts by weight of $CaCO_3$ (NS#2500 manufactured by Nitto Funka Kogyo K.K., average particle size: 0.89 μm) were dry-mixed by a ball mill, blended while heating in a kneader, pulverized by a jet mill after solidification and then classified to provide toner of a particle size ranging 5~25 μm. Further added to this toner was 0.5 parts by weight of the same silicon carbide finer powde and dry-mixed to provide the toner of a coated present invention.

Using this toner, an electrostatic latent image on the OPC photosensitive member was developed and the resulting toner image was transferred onto a plain paper and then fixed by a heat roll under conditions of fixing temperature of 165° C. and fixing pressure of 1 kg/cm. Incidentally, the development was carried out by rotating a sleeve 1 at 65 mm/sec with a doctor gap of 0.05 mm such that photosensitive member 10 and sleeve 1 were almost in contact with each other. DC bias voltage of −80 V was applied between the sleeve 1 and the doctor blade 6 in the apparatus of FIG. 1.

The resulting image was clear without fogging with a density of 1.38 and a resolution of 5.6 /mm. And after producing 10,000 copies consecutively, the sleeve surface was observed, finding that there was substantially no adhesion of the toner to the sleeve surface.

EXAMPLE 2

Toner was prepared under the same conditions as in Example 1 except that the amount of silicon carbide fine powder contained in the toner was 1.3 parts by weight and the amount of $CaCO_3$ was 6.7 parts by weight. With this toner, copying was conducted under the same condition as in Example 1, providing good results as in Example 1.

EXAMPLE 3

Toner was prepared under the same conditions as in Example 1 except that the amount of silicon carbide fine powder contained in the toner was 0.8 parts by weight and the amount of $CaCO_3$ was 7.2 parts by weight. With this toner, copying was conducted under the same condition as in Example 1, providing good results as in Example 1.

COMPARATIVE EXAMPLE 1

Toner was prepared under the same conditions as in Example 1 except for adding 8 parts by weight of $CaCO_3$ without using silicon carbide fine powder. After coating this toner with 0.5 weight % of silicon carbide fine powder, copying was conducted under the same conditions as in Example 1. Image quality was good in the initial stage, but after 10,000 consecutive copying operations, an image had a density of 0.75 and a resolution of 3 /mm, and the sleeve surface was covered by a thin layer of the toner. It is presumed that since the silicon carbide fine powder can move freely on the toner surface, only little abrasion effect can be obtained.

COMPARATIVE EXAMPLE 2

Toner was prepared under the same conditions as in Example 1 except that the amount of the base resin was 84 parts by weight without adding $CaCO_3$. This toner was coated with 0.5 wt % silicon carbide fine powder and then copying was conducted using this toner under the same conditions as in Example 1. The resulting image had high quality in the initial stage, but after 10,000 consecutive copying operations the image had a density of 0.53 and a resolution of 3 /mm. This deterioration of the image quality was severer than in Comparative Example 1. It is expected from this that $CaCO_3$ has an effect of preventing filming.

COMPARATIVE EXAMPLE 3

Toner was prepared under the same conditions as in Example 1 except that the amount of silicon carbide fine powder was 0.2 parts by weight and that of $CaCO_3$ was 7.8 parts by weight. With this toner, copying was conducted under the same conditions as in Example 1. The resulting image was good in the initial stage, but after 10,000 consecutive copying operations the image had a density of 1.05 and a resolution of 4.5 /mm, and it was observed that the toner was attached to the sleeve surface.

COMPARATIVE EXAMPLE 4

Toner was prepared under the same conditions as in Example 1 except that the amount of silicon carbide fine powder was 3.7 parts by weight, that of $CaCO_3$ was 5.9 parts by weight and that of the base resin was 75.4 parts by weight. With this toner, copying was conducted under the same conditions as in Example 1. The image quality was initially good, but after 10,000 consecutive copying operations, it was observed that an OPC photosensitive member was damaged although the sleeve itself was not covered by the toner. Also, the resulting image was observed to have defects which were presumably transferred from the scratches of the OPC photosensitive member surface.

EXAMPLE 4

Toner was prepared under the same conditions as in Example 1 except that 1.5 parts by weight of silicon nitride fine powder (KSN-10 manufactured by Shinetsu Chemical Co., Ltd., average particle size: 0.8 μm) was added in place of silicon carbide fine powder, and that the amount of $CaCO_3$ was 6.9 parts by weight and that of the base resin was 76.6 parts by weight. Toner was then coated by 0.8 parts by weight of silicon carbide fine powder (DU A-1 manufactured by Showa Denko K.K.).

The image produced by this toner had good quality, and even after 10,000 consecutive copying operations substantially no toner was attached to the sleeve surface.

EXAMPLE 5

Toner was prepared under the same conditions as in Example 4 except for using silicon carbide fine powder having an average particle size of 1.0 μm (DU A-3 manufactured by Showa Denko K.K.). The toner was then coated with 0.5 parts by weight of silicon carbide fine powder (DU A-1 manufactured by Showa Denko K.K.) and 0.5 parts by weight of methyl methacrylate resin fine powder having an average particle size of 0.3 μm. As a result of copying with this toner, the same results as in Example 4 were obtained. With respect to image quality too, it was as good as in Example 4.

EXAMPLE 6

Toner was prepared under the same conditions as in Example 4 except for using silicon carbide fine powder having an average particle size of 0.7 μm (DU A-2 manufactured by Showa Denko K.K.). By copying with this toner, the same results as in Example 4 were obtained.

EXAMPLE 7

Toner was prepared under the same conditions as in Example 4 except for using silicon carbide fine powder having an average particle size of 1.85 μm (UFP-3 manufactured by Shinetsu Chemical Co., Ltd.). By copying with this toner, the same results as in Example 4 were obtained.

COMPARATIVE EXAMPLE 5

Toner was prepared under the same conditions as in Example 4 except for using silicon carbide fine powder having an average particle size of 4 μm (DU A-4 manufactured by Showa Denko K.K.), and copying was conducted. As a result, the image quality was good in the initial stage, but after 10,000 consecutive copying operations, the toner quality decreased and the sleeve surface was damaged although no toner was attached thereto.

EXAMPLE 8

The toner prepared in Example 1 was dry-mixed with silicon carbide fine powder (DU A-1 manufactured by Showa Denko K.K., average particle size: 0.45 μm) in an amount of 0.1, 0.2, 0.5, 0.8, 1.0 and 1.5 wt %, respectively, to uniformly adhere the fine powder to the toner surface.

With each toner, a 10,000-consecutive-copying test was conducted as in Example 1. Incidentally, as a development roller, a semi-conductive urethane rubber roller having a volume resistivity of $10^6$ Ω.cm was used. As a result, it was observed that when the content of silicon carbide fine powder was 0.1 wt %, toner filming existed on the roller surface, and that image density was as low as 0.63. For the other toners, no filming was observed. However, when the fine powder content was 1.5 wt %, slight fogging was observed from the initial stage, and after 10,000 copying operations the OPC photosensitive member surface was damaged, resulting in streaks on the resulting image.

EXAMPLE 9

10 parts by weight of silicon carbide fine powder having an average particle size of 1.5 μm (DU A-3C manufactured by Showa Denko K.K.) was charged into a high-speed mixer, and a solution of 1 part by weight of hexamethyldisilazane (HMDS) in 8 part by weight of hexane was added into the mixture, and stirred at 2,000 rpm while heating at 150° C. for 1 hour to make the fine powder hydrophobic.

Next, 77 parts by weight of styrene-acrylic copolymer (Highmer SBM 600 manufactured by Sanyo Chemical Co., Ltd.), 10 parts by weight of carbon black (#50 manufactured by Mitsubishi Kasei Kogyo K.K.), 3 parts by weight of low-molecular weight polypropylene (Biscohl 550P manufactured by Sanyo Chemical Co., Ltd.), 2 parts by weight of an charge control agent (Bontron E81 manufactured by Orient Chemical Industries Ltd.), and the above silicon carbide fine powder (DU A-3C) and $CaCO_3$ (NS#2500 manufactured by Nitto Funka Kogyo K.K.) in amounts shown in Table 1 were dry-mixed by a ball mill, blended while heating in a kneader, pulverized by a jet mill after solidification and then classified to provide toner of a particle size ranging 5~25 μm. Further added to each toner was 0.5 parts by weight of silicon carbide (DU A-1) fine powder and dry-mixed to provide the toner of the present invention.

Using each toner, 10,000 copies were produced consecutively under the conditions of 25° C. and 80% RH. The resulting image was evaluated. The results are shown in Table 1.

As is clear from Table 1, the toner of the present invention (Nos. 1~3) can provide high image quality in 10,000 consecutive copying. However, No. 4 shows that slight damage on OPC was observed which in turn produced streaks in the image.

TABLE 1

| | Amount (Parts by Weight) | | Image Density | | Resolution (Number/mm) | | Surface |
|---|---|---|---|---|---|---|---|
| No. | Silicon Carbide | $CaCO_3$ | Initial Stage | 10,000 Copying | Initial Stage | 10,000 Copying | Condition of Sleeve |
| 1 | 0.5 | 7.5 | 1.38 | 1.25 | 5.6 | 5.6 | No toner adhesion |
| 2 | 1.0 | 7.0 | 1.35 | 1.30 | 5.6 | 5.6 | No toner adhesion |
| 3 | 2.0 | 6.0 | 1.39 | 1.33 | 5.6 | 5.6 | No toner adhesion |
| 4 | 4.0 | 4.0 | 1.42 | 1.28 | 5.6 | 5.0 | No toner adhesion* |

Note
*Scratches were observed on OPC.

EXAMPLE 10

Toner was prepared under the same conditions as in Example 9 except that silicon nitride fine powder (KSN-10 manufactured by Shinetsu Chemical Co., Ltd., average particle size: 0.7 μm) was used in place of silicon carbide fine powder in Example 1 and that octyltrimethoxysilane was used as an agent for making hydrophobic, and consecutive copying was conducted to evaluate the resulting toner image quality. Table 2 shows the results of evaluating the image quality together with the formulation of the toner.

TABLE 2

| | Amount (Parts by Weight) | | Image Density | | Resolution (Number/mm) | | Surface |
|---|---|---|---|---|---|---|---|
| No. | Silicon Carbide | $CaCO_3$ | Initial Stage | 10,000 Copying | Initial Stage | 10,000 Copying | Condition of Sleeve |
| 1 | 0.5 | 7.5 | 1.35 | 1.25 | 5.6 | 5.6 | No toner adhesion |
| 2 | 1.0 | 7.0 | 1.38 | 1.32 | 6.3 | 5.6 | No toner adhesion |
| 3 | 2.0 | 6.0 | 1.36 | 1.35 | 5.6 | 5.6 | No toner adhesion |
| 4 | 4.0 | 4.0 | 1.35 | 1.25 | 5.6 | 5.0 | No toner adhesion* |

Note
*Scratches were observed on OPC.

As is clear from Table 2, silicon nitride fine powder has a function of abrading and cleaning the sleeve surface like the above silicon carbide fine powder, and the hydrophobic treatment makes the toner highly resistant to moisture at a high humidity, leading to high-quality image.

EXAMPLE 11

Toner was prepared in the same manner as in Example 9 by using silicon carbide fine powder having an average particle size of 4 μm (obtained by classification of DU A-4 manufactured by Showa Denko K.K.), 1.0 μm (DU A-3), 0.7 μm (DU A-2), and 0.45 μm (DU A-1), respectively. With each toner, the image was developed and its quality was evaluated. Incidentally, each toner was coated with 0.5 wt % silicon carbide fine powder. When the toner containing silicon carbide fine powder having an average particle size of 4 μm was used, the image quality decreased after 10,000 consecutive copying, and scratches were observed on the surfaces of the sleeve and the OPC photosensitive member although no toner adhered to the sleeve surface. With respect to those having other average particle sizes, a good image was obtained as in Example 9, and the sleeve surface was not covered by toner and no scratches were observed.

In the Examples, the function of the toner was explained in the development apparatus as shown in FIG. 1, but it is noted that similar functions can be expected in any other nonmagnetic one-component development apparatus.

As explained above in detail, the toner of the present invention contains calcium carbonate and ceramic fine powder. Accordingly, when it is used in a nonmagnetic one-component development method using a dielectric sleeve equipped with electrodes or a conductive sleeve, high-quality images can be obtained without forming a thin layer of the toner on the sleeve surface, even after producing a large number of copies.

Figure 2:
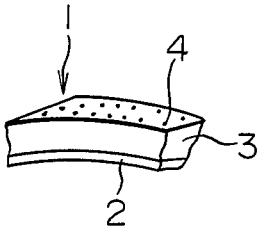
FIG. 2 is a schematic perspective view showing a sleeve which may be used in the development apparatus shown in FIG. 1.

A main factor determining the service life of the development apparatus is adhesion of the toner to the toner-bearing member, and the toner of the present invention does not tend to adhere to the toner-bearing member. It is clear that the same effect can be achieved even in other apparatuses than shown in FIGS. 1 and 2.

The present invention has been described by the above Examples, but it should be noted that any modifications can be made unless they deviate from the scope of the present invention defined by the claims attached hereto.

What is claimed is:

1. Electrostatic development toner comprising toner particles each including a binder resin, 1–10 weight % of fine calcium carbonate particles having an average particle size of 1 μm or less, and 0.3–3.5 weight % of fine ceramic particles dispersed in said toner particles and also 0.2–1.0 weight % of fine ceramic particles disposed on the surfaces of said toner particles, said fine ceramic particles having high hardness and high abrasion characteristics and an average particle size of 0.1–3 μm, at least some of said fine calcium carbonate particles and said fine ceramic particles being partially exposed on the surfaces of said toner particles.

2. The electrostatic development toner according to claim 1, wherein said ceramic fine powder is made of nitride or carbide ceramics or a mixture thereof.

3. The electrostatic development toner according to claim 1, wherein said ceramic fine powder is treated to have hydrophobic nature.

4. The electrostatic development toner as in claim 1 wherein each toner particle further includes one or more additives selected from the group consisting of colorants, charge control agents, release agents, fillers, flow control agents, and film control resins.

* * * * *